United States Patent [19]

Weinbaum

[11] Patent Number: 4,932,566

[45] Date of Patent: Jun. 12, 1990

[54] LIQUID SOAP DISPENSER

[76] Inventor: Eliezer Weinbaum, 1443-42 St., Brooklyn, N.Y. 11219

[21] Appl. No.: 295,133

[22] Filed: Jan. 9, 1989

[51] Int. Cl.[5] ..... B67D 5/64

[52] U.S. Cl. ..... 222/175; 222/212; 222/548; 401/6; 248/102; 224/148

[58] Field of Search ..... 222/175, 548, 185, 212, 222/215; 248/444, 102; 206/581, 229; 224/148, 202; 401/6; D3/61, 62; D9/442; D28/76

[56] References Cited

U.S. PATENT DOCUMENTS

| | | | |
|---|---|---|---|
| 1,637,635 | 8/1927 | Corley | 222/175 X |
| 2,235,350 | 3/1941 | Anderson | 222/175 X |
| 3,198,406 | 8/1965 | Kopelman | 222/548 X |
| 4,023,712 | 5/1977 | Babiak et al. | 222/175 |
| 4,768,688 | 9/1988 | Harrigan | 222/175 X |

FOREIGN PATENT DOCUMENTS

| | | | |
|---|---|---|---|
| 87/02873 | 5/1987 | PCT Int'l Appl. | 222/148 |

*Primary Examiner*—Michael S. Huppert
*Assistant Examiner*—Gregory L. Huson
*Attorney, Agent, or Firm*—Leon Gilden

[57] ABSTRACT

A liquid soap dispenser is formed with a central body including a plurality of upwardly depending legs tapering to a reduced dimension from the central body to terminal ends of the legs which are in a normally abutting end-to-end relationship to enable flexure of the legs relative to the central body for securement of the dispenser about the neck portion of an individual. The central body is formed with a downwardly depending extension with an arcuate slot selectively alignable with an arcuate slot formed within a rotatably mounted cap overlying the extension for selective dispensing of soap from within the transparent dispenser.

1 Claim, 1 Drawing Sheet

LIQUID SOAP DISPENSER

BACKGROUND OF THE INVENTION

1. Field of the Invention

The field of invention relates to soap dispensers, and more particularly pertains to a new and improved liquid soap dispenser wherein the same may be comfortably supported about the neck of a user during use.

2. Description of the Prior Art

The use of soap dispensers during a washing or showering of an individual are well known in the prior art. Conventionally, the soap dispensers of the prior art have exposed the soap utilized during a bathing engagement to constant erosion by action of the water spray upon the soap. For example, U.S. Pat. Nos. 2,099,484 and 2,182,293 to Hockerk are illustrative of typical examples of the prior art securing a tether-like rope to a bar of soap to be worn about the body of a user. The Hockerk patents are typical of the prior art exposing the soap to constant erosion and further requiring receptacles for support of the soap during periods of non-use to avoid melting action of the soap subsequent to use onto a support surface.

U.S. Pat. No. 2,679,709 to Du Bois sets forth a further example of a soap bar positionable within a housing wherein the soap bar may be downwardly drawn from the housing for use. The Du Bois patent is not of a body supported soap, but is of interest relative to the configuration of the securement of an extensible and retractable tether aligned to an associated bar of soap.

U.S. Pat. No. 3,519,568 Needleman sets forth a soap bar with a flexible tether line secured thereto with associated grooves in the soap bar to accommodate the tether line during packaging thereof.

U.S. Pat. No. 4,062,792 to McNabb sets forth a support plate positioned between a plurality of soap halves for securement of the soap to a tether line with alternatives utilizing a porous container overlying an expansible mold for accepting soap injected therewithin. The McNabb device is of interest relative to the use of a liquid soap within a chamber for support by a user.

As such, it may be appreciated that there is continuing need for a new and improved liquid soap dispenser which addresses both the problems of convenience and effectiveness, and in this respect the present invention substantially fulfills this need.

SUMMARY OF THE INVENTION

In view of the foregoing disadvantages inherent in the known types of soap dispensers now present in the prior art, the present invention provides a liquid soap dispenser wherein the same protectively encloses liquid soap during periods of use and further enables convenient securement by flexure of terminal ends of the container about the neck portion of a user. As such, the general purpose of the present invention, which will be described subsequently in greater detail, is to provide a new and improved liquid soap dispenser which has all the advantages of the prior art liquid soap dispensers and none of the disadvantages.

To attain this, the present invention comprises a bifurcated, transparent body portion including upwardly depending flexible legs normally contiguously adjoining at free terminal ends thereof wherein the legs are tapered inwardly from said central body portion to said terminal ends to enable flexure of said legs to secure the dispenser about the neck of a user thereof. The cap is rotatably mounted on to an extension of the main body portion and selectively aligns and misaligns an arcuate window to enable selective flow of soap from within said dispenser outwardly thereof.

My invention resides not in any one of these features per se, but rather in the particular combination of all of them herein disclosed and claimed and it is distinguished from the prior art in this particular combination of all of its structures for the functions specified.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved liquid soap dispenser which has all the advantages of the prior art soap dispensers and none of the disadvantages.

It is another object of the present invention to provide a new and improved liquid soap dispenser which may be easily and efficiently manufactured and marketed.

It is a further object of the present invention to provide a new and improved liquid soap dispenser which is of a durable and reliable construction.

An even further object of the present invention is to provide a new and improved liquid soap dispenser which is susceptible of a low cost of manufacture with regard to both materials and labor, and which accordingly is then susceptible of low prices of sale to the consuming public, thereby making such liquid soap dispenser economically available to the buying public.

Still yet another object of the present invention is to provide a new and improved liquid soap dispenser which provides in the apparatuses and methods of the prior art some of the advantages thereof, while simultaneously overcoming some of the disadvantages normally associated therewith.

Still another object of the present invention is to provide a new and improved liquid soap dispenser provided with a bifurcated body portion of tapering cross-sectional configuration to enable flexure of the terminal ends of the body portion about the neck of a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
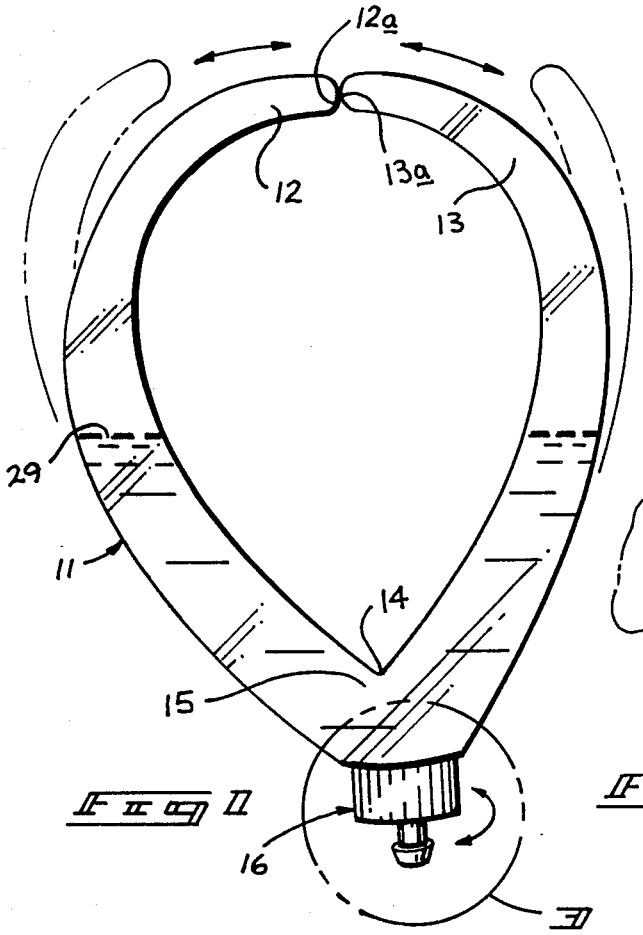
FIG. 1 is an isometric illustration of the instant invention.

With reference now to the drawings, and in particular to FIGS. 1 to 4 thereof, a new and improved liquid soap dispenser embodying the principles and concepts of the present invention and generally designated by the reference numeral 10 will be described.

More specifically, it will be noted that the liquid soap dispenser 10 essentially comprises a bifurcated downwardly depending transparent body 11 formed with a first leg 12 and a second leg 13 terminating in an arcuate first terminal end 12*a* and an arcuate second terminal end 13*a* respectively. The first and second legs 12 and 13 join at an apex 14 to form a central body portion 16. The legs taper downwardly from a first cross-sectional dimension at the apex 14 downwardly to the respective arcuate first and arcuate second terminal ends 12*a* and 13*a*. In this manner, the legs are capable of substantial flexure, as indicated in phantom in FIG. 1.

Figure 2:
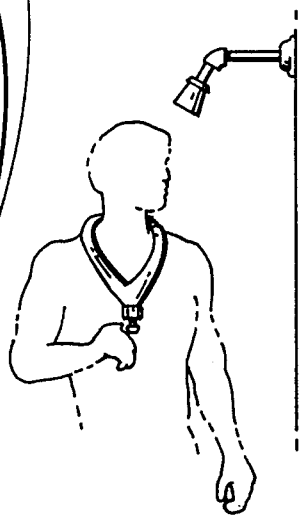
FIG. 2 is an orthographic view taken in elevation of the instant invention secured about a user thereof.
Figure 3:
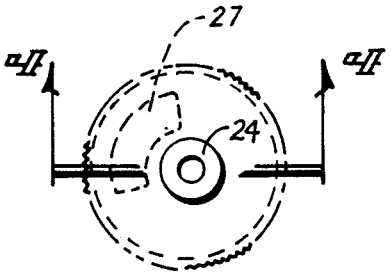
FIG. 3 is a top plan view of the cap of the instant invention per the portion 3, as set forth in FIG. 1.
Figure 4:
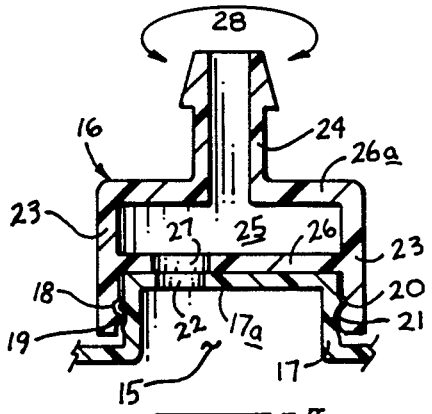
FIG. 4 is an orthographic view taken along the lines 4—4 of FIG. 3 in the direction indicated by the arrows.

The arcuate first and arcuate second terminal ends 12*a* and 13*a* are normally in contiguous touching engagement with one another at their respective confronting ends to avoid pinching the skin of an individual wearing the dispenser during a showering operation, as illustrated in FIG. 2. The central body portion 15 is formed with a rotatably mounted cap 16 rotatably mounted onto a body extension 17 of the central body portion 15.

The body extension 17 is formed with a connecting web 17*a* mounted orthogonally to the circumferential side wall of the body extension 17 and is formed with a circumferential body ridge 18 and a spaced parallel circumferential body groove 19 formed on the exterior surface of the body extension 17 to cooperate with a circumferential cap groove 20 and a circumferential cap ridge 21 formed on an interior surface of a circumferential skirt 23 of the cap 16. The cap 16 is rotatable relative to an axis of rotation 28 of the cap 16 and of the body extension 17. The cap 16 is further formed with an outwardlly depending orthogonally oriented nozzle 24 formed medially of an upper web 26*a* overlying a lower cap web 26 to define a cavity 25 therewithin.

A first arcuate slot 22 is formed within a web 17*a* of the body extension 17 wherein the arcuate slot is radially spaced from the axis of rotation 28 an equal distance to a second arcuate slot 27 formed within the lower cap web 26 whereby the rotation of the cap 16 to present the first arcuate slot 22 in alignment with the second arcuate slot 27 enables dispensing of the liquid soap 29 from within the cavity of the bifurcated transparent body 11.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A liquid soap dispensing apparatus containing liquid soap for securement about the neck of an individual, said apparatus comprising, a bifurcated hollow reservoir body including an upwardly extending hollow flexible first leg, and an upwardly extending flexible hollow second leg wherein said first and second legs define end surfaces which are resiliently biased towards one another to define a closed continuous internal periphery of said body in a first position, and wherein said first and second legs define an open periphery in a second position when said end surfaces are pulled away from one another, and said first and second legs merge and communicate in a communicating apex to define a central body portion remote from said end surfaces, and a cap rotatably mounted onto said central body portion overlying said apex to enable selective dispensing of said soap, and wherein said first and second legs end surfaces are formed with respective arcuate first and second terminal ends wherein said ends are in abutting contact in said first position, and wherein said first and second legs are defined by a tapering cross-sectional configuration from said central body portion through said terminal ends to enhance flexure of said legs from said first position to said second position, and wherein a body extension extends outwardly of said central body portion and said body extension is of a cylindrical configuration and defines a circumferential body ridge on an exterior surface thereof spaced parallel to a circumferential body groove, and wherein said body ridge and said body groove rotatably cooperate with a respective cap groove and cap ridge on said cap at an extension thereof to secure said cap extension onto said body extension in a rotatable manner, and wherein said cap and said body extension are coaxially aligned, and wherein said body extension includes a web orthogonally formed over a terminal end of said body extension with a first arcuate slot radially formed about the axial center of said web, and wherein said cap includes a lower web formed overlying said cap groove and said cap ridge with a second arcuate slot formed in said cap lower web spaced from the axial center of said cap web a distance equal to the spacing of said first arcuate slot from the axial center of said body web, and wherein said cap further includes a nozzle mounted to an upper web axially aligned with said lower web and said body web, said upper web is spaced from said lower web a distance to define a cavity therebetween.

* * * * *